US008087420B1

(12) United States Patent
Lukacsy

(10) Patent No.: US 8,087,420 B1
(45) Date of Patent: Jan. 3, 2012

(54) GRAVITY-POWERED, WIND-RESISTANT AND SELF-OPENING UMBRELLA SYSTEM

(75) Inventor: Steven A. Lukacsy, El Sobrante, CA (US)

(73) Assignee: Steven A. Lukacsy, El Sobrante, CA (US)

( * ) Notice: Subject to any disclaimer, the term of this patent is extended or adjusted under 35 U.S.C. 154(b) by 0 days.

(21) Appl. No.: 13/093,633

(22) Filed: Apr. 25, 2011

(51) Int. Cl.
*A45B 25/16* (2006.01)

(52) U.S. Cl. ..... 135/22; 135/20.3; 135/98

(58) Field of Classification Search ..... 135/16, 135/98, 20.3, 22, 120.3, 28–29, 905, 912; 211/197
See application file for complete search history.

(56) References Cited

U.S. PATENT DOCUMENTS 2,745,421 A * 5/1956 Russell ..... 135/38
4,567,907 A * 2/1986 Dubinsky ..... 135/20.3
4,807,655 A * 2/1989 Robertson ..... 135/22
5,640,984 A * 6/1997 Dubunsky ..... 135/33.2
5,740,822 A * 4/1998 Einck ..... 135/16
5,829,462 A * 11/1998 Cho ..... 135/22
6,129,101 A * 10/2000 Dubinsky ..... 135/20.3
6,170,497 B1 * 1/2001 Ma ..... 135/20.3
6,173,721 B1 1/2001 Mery
6,338,353 B1 * 1/2002 Chen ..... 135/20.3
6,415,805 B1 * 7/2002 Kuo ..... 135/22
6,889,699 B2 * 5/2005 Clarke ..... 135/20.3
7,174,905 B2 * 2/2007 Hung ..... 135/20.1
7,293,573 B2 * 11/2007 Clarke ..... 135/20.3
7,520,289 B1 * 4/2009 Barber ..... 135/21
7,735,498 B2 6/2010 You

* cited by examiner

*Primary Examiner* — Winnie Yip
(74) *Attorney, Agent, or Firm* — Syndicated Law; Brian S. Boyer

(57) ABSTRACT

The teachings provided herein are generally directed to gravity-powered, and self-opening umbrella systems that can also be wind-resistant. As evidenced from the teachings provided herein, the systems can be designed in a variety of configurations. The umbrella system can include a counterweight and system of pulleys, where the system of pulleys includes class 1 and class 2 pulleys configured with the counterweight to gain a mechanical advantage in the normal operation of the umbrella. The umbrella can be, for example, a patio umbrella in which the mechanical advantage provides a self-opening of an umbrella canopy and ease-of-retracting of the canopy for a user. And, the system can also be dynamic, such that it's also resistant to external forces, such as the wind.

20 Claims, 4 Drawing Sheets

GRAVITY-POWERED, WIND-RESISTANT AND SELF-OPENING UMBRELLA SYSTEM

BACKGROUND

1. Field of the Invention

The teachings provided herein are generally directed to gravity-powered, wind-resistant, and self-opening umbrella systems.

2. Description of the Related Art

Everyone is familiar with the use and limitations of currently available umbrella systems. State-of-the-art umbrella systems have problems in their construction and operation that, if solved, would be very beneficial in the art.

Umbrellas can be designed, for example, to restrict or block rain, wind and/or sunlight. And, they can be handheld or non-handheld, typically larger umbrellas. The non-handheld type can include a fixed-position use, a portable use, or even a hybrid use that can be fixed or portable. These larger umbrellas are often used on beaches, patios, decks, courtyards and sidewalks, and are available in variety of configurations, And, the choice of configuration usually includes considering a number of main factors, such as the intended use (e.g., handheld or non-handheld), ease-of-use (e.g., force needed to open and close, as well as carry), cost, and durability. At the time of purchase, an umbrella can be assumed to function as intended. A variety of mechanical configurations are available to provide ease of opening and closing, for example, but these configurations will often affect cost detrimentally, as well as weight and, thus, portability. As such, existing systems suffer trade-offs, and there is no good balance. Moreover, existing systems tend to be limited in wind-resistance.

One of skill will appreciate an umbrella that functions as intended, while providing a balance of (i) ease of use, (ii) reasonable cost, and (iii) durability that includes wind resistance.

SUMMARY

The teachings provided herein are generally directed to gravity-powered, and self-opening umbrella systems that can also be wind-resistant. The umbrella systems can include, for example, nearly any configuration desired by a user. In some embodiments, the umbrella covering can be, for example, a patio umbrella covering with a mechanical advantage for self-opening and retracting, the mechanical advantage based on a gravitational power supplied by a counterweight and pulley system taught herein.

The teachings include an umbrella system comprising a static component, a dynamic component, a counterweight component, and a compound pulley component. The static component can have a top portion, and the dynamic component can include a retractable umbrella covering having a center and an outer edge. The center of the covering can be attached to the top portion of the pole, and there can be a plurality of ribs for supporting the umbrella covering. There can also be a runner circumscribing the pole, adapted to slide vertically on the pole and coupled to the plurality of ribs through a plurality of stretchers. And, there can be a user rope having a fixed-end and a user-end, the user end receiving a force, $F_1$, applied by a user to close the umbrella covering. The umbrella system can also have a counterweight component to provide a gravitational force, $F_2$. The umbrella system can also have a compound pulley component including, for example, a class-1 pulley attached to the static component, a class-2 pulley attached to the dynamic component, and a pulley rope (i) having a fixed end and a weighted end attached to the counterweight component, and (ii) in operable connection with the pulleys to provide a mechanical advantage to the umbrella system.

The teachings are also directed to an umbrella system that is a gravity-powered, self-opening patio umbrella. The umbrella can have a pole with a top end portion; a umbrella covering having a center attached to the top end of the pole; a plurality of ribs for supporting the umbrella covering; a runner that circumscribes the pole, is adapted to slide vertically on the pole and is coupled to the plurality of ribs through a plurality of stretchers; a rope having a fixed end and a user-end that can receive a force $F_1$ to close the umbrella covering by a user; a counterweight to provide a gravitational force, $F_2$, for a self-opening of the umbrella covering; and, a pulley system having a fixed pulley, a moveable pulley, and a pulley rope. The pulley rope can have a fixed end for receiving $F_1$ and a weighted end attached to the counterweight. The pulley rope can also be in operable connection with the pulleys and the counterweight to provide a mechanical advantage to the umbrella of at least 2.

The teachings are also directed to a balanced, gravity-powered, and self-opening patio umbrella comprising a cylindrical pole, a retractable patio umbrella covering, a plurality of ribs for supporting the umbrella covering, a runner circumscribing the pole, a user rope, a counterweight, a pulley system. The cylindrical pole can have a base portion and a top portion. The retractable patio umbrella covering can have a center and an outer edge, the center attached to the top portion of the pole. The plurality of ribs can be used to support the umbrella covering and can emanate radially from the center to the outer edge of the umbrella covering. The runner can circumscribe the pole, be adapted to slide vertically on the pole, and be coupled to the plurality of ribs through a plurality of stretchers. The user rope can have a fixed end and a user end, the user end configured to receive a force $F_1$ from a user; and, the fixed end operably attached to the runner. The counterweight can provide a gravitational force, $F_2$, the counterweight contained within the cylindrical pole. And, the pulley system can have a fixed pulley, a moveable pulley, and a pulley rope. In some embodiments, the pulley rope can have (i) a fixed end for receiving the force $F_1$, (ii) a weighted end attached to the counterweight component, and (iii) an operable connection with the pulleys to provide a mechanical advantage to the umbrella of at least 2.

The teachings are also directed to a counterweighted, self-opening umbrella. The umbrella can have a pole with a top end and a bottom end, along with a retractable umbrella covering attached at its center to the top end of the pole. The umbrella can include a mechanical support framework for opening and retracting the umbrella covering. The umbrella can also include a fixed pulley operably attached to the pole, a moveable pulley operably attached to the mechanical support framework for the umbrella, a pulley rope in operable contact with the pulleys and a counterweight to open and retract the umbrella with a mechanical advantage of at least 2 from the pulleys, and a user rope having a fixed end and a user end, the user end receiving a force from a user to retract the retractable umbrella. The umbrella can (i) self-open using only the gravitational force of the counterweight and (ii) retract with a minimal force, due to the mechanical advantage.

The static component can take any of a variety of forms known to one of skill such as, for example, a pole. In some embodiments, the pole can comprise a cylindrical pole. Moreover, the cylindrical pole can contain the counterweight in some embodiments.

In some embodiments, $F_2$ is substantially greater than $f_t$+0.5 $F_3$; $F_3$ is the upward vertical force on the runner, in the absence of any friction, applied to open the umbrella covering; and, $f_t$ is the total frictional force in the system realized at the counterweight component. And, in some embodiments, $F_2$ can be at least 4 pounds greater than $f_t$+0.5 $F_3$, and $F_1$ can sometimes be no more than about 8 pounds. In some embodiments, the umbrellas taught herein can be designed such that the forces are balanced on each side of the pole.

In some embodiments, the compound pulley component can comprise two class-1 pulleys, two class-2 pulleys, and a cable-tension compensator pulley to balance forces between the pulleys. In some embodiments, the compound pulley component can comprise two fixed pulleys, two moveable pulleys, and a tension compensator pulley to balance forces between the pulleys. The moveable pulleys, for example, can be (i) in operable contact with the rope, (ii) positioned between the fixed-end and the user-end of the rope, and (iii) function to provide the mechanical advantage. The system of pulleys can have one fixed pulley and one moveable pulley on each side of the pole, functioning to provide the mechanical advantage. Moreover, the pulley rope can comprise a cable rope.

DETAILED DESCRIPTION

The teachings provided herein are generally directed to gravity-powered, and self-opening umbrella systems that can also be wind-resistant. As evidenced from the teachings provided herein, the systems can be designed in a variety of configurations. The umbrella system can include a counterweight and system of pulleys, where the system of pulleys includes class 1 and class 2 pulleys configured with the counterweight to gain a mechanical advantage in the normal operation of the umbrella. The umbrella can be, for example, a patio umbrella in which the mechanical advantage provides a self-opening of an umbrella canopy and ease-of-retracting of the canopy for a user. And, the system can also be dynamic, such that it's also resistant to external forces, such as the wind.

The term "mechanical advantage" describes an important feature of the teachings provided herein and can be used to refer to a ratio of the force produced by the umbrella system to the force applied to it by a user. For example, if a user applies a force, such as a force, F, to operate an umbrella as taught herein, the mechanical advantage can be any multiple obtained by one of skill in the mechanical design of the system, such that the multiple is a multiplier of the force, F, applied by the user. In some embodiments, the multiple can be equal to, or approximately, 1.25×, 1.50×, 1.75×, 2.00×, 2.50×, 3.00×, 3.50×, 4.00×, 4.50×, 5.00×, or greater, of the force applied by the user. One of skill will appreciate that systems variables, such as system friction, can vary the amount of the multiple obtained from most any design. And, any advantage greater than 1.00× can be seen in some embodiments. In some embodiments, the mechanical advantage can include operational longevity, durability, and the like, due to the construction, and simplicity thereof, of the umbrella systems taught herein. And, the term "wind resistant" can refer to the ability of the umbrella to withstand wind forces applied to the umbrella while it is in the open position, where the wind-resistant character of the umbrella can include the dynamic movement of mechanical systems taught herein as they receive forces from the wind during operation.

Figure 1A:
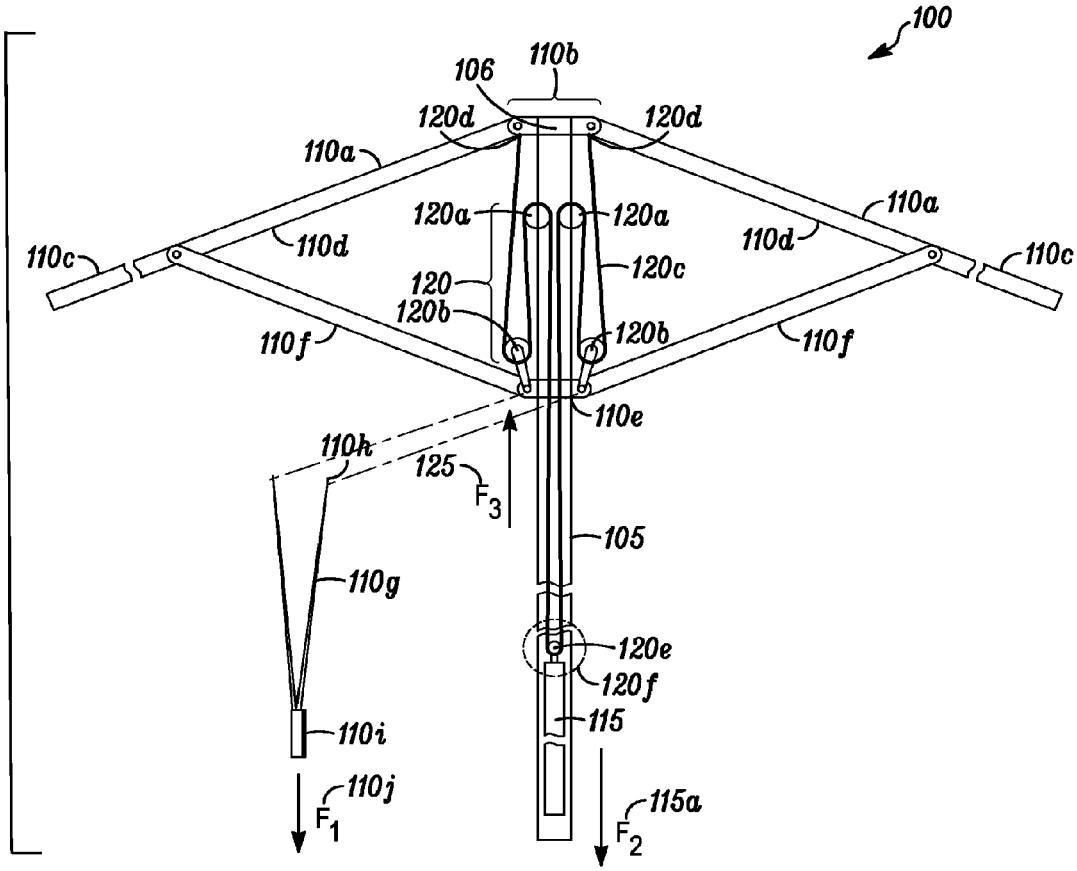
FIGS. 1A and 1B illustrate umbrella systems, according to some embodiments.
Figure 1B:
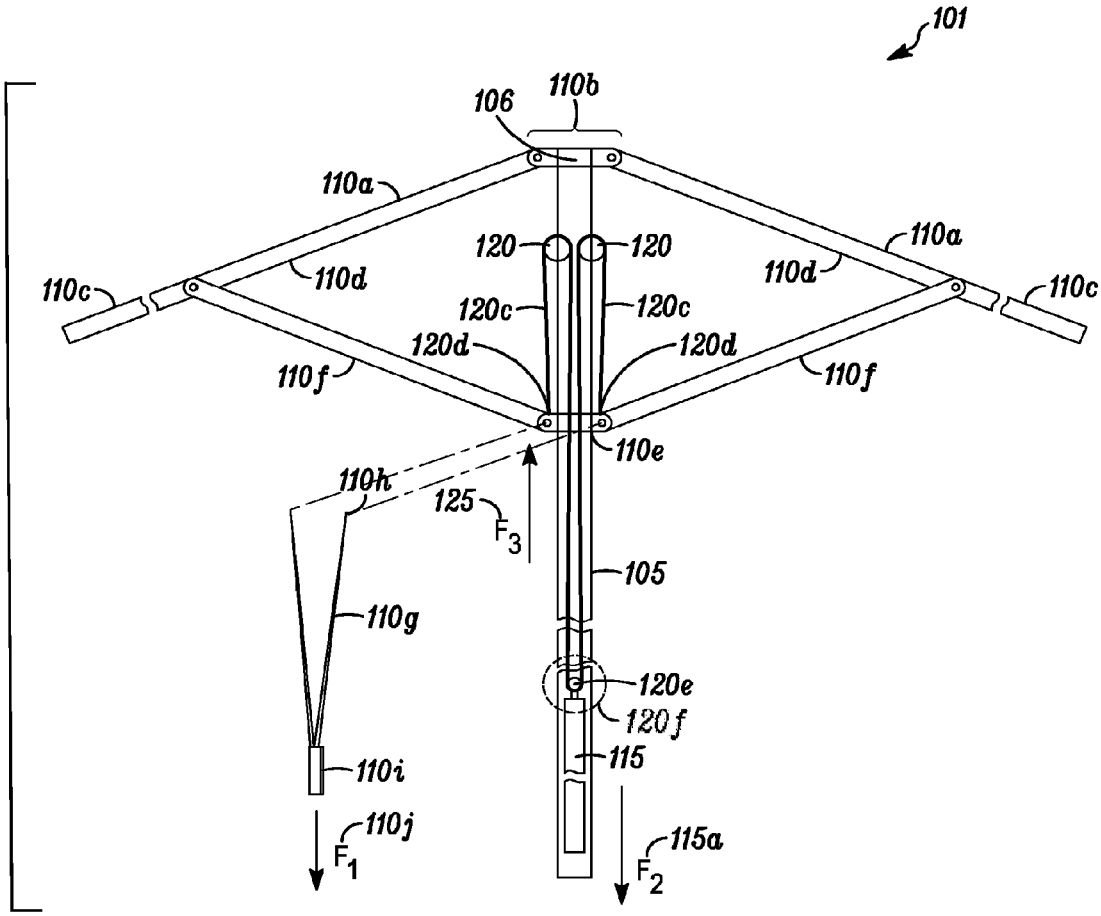

FIGS. 1A and 1B illustrate umbrella systems, according to some embodiments. In FIG. 1A, the umbrella system 100 comprises a static component 105, a dynamic component 110, a counterweight component 115, and a compound pulley component 120. The static component 105 can have a top portion 106, and the dynamic component 110 can include a retractable umbrella covering 110*a* having a center 110*b* and an outer edge 110*c*. The center 110*b* of the covering 110*a* can be attached to the top portion 106 of the cylindrical pole 105, and there can be a plurality of ribs 110*d* for supporting the umbrella covering 110*a*. There can also be a runner 110*e* circumscribing the pole 105, adapted to slide vertically on the pole 105 and coupled to the plurality of ribs 110*d* through a plurality of stretchers 110*f*. And, there can be a user rope 110*g* having a fixed-end 110*h* and a user-end 110*i*, the user end receiving a force, $F_1$ 110*j*, applied by a user to close the umbrella covering 110*a*. The umbrella system 100 can also have a counterweight component 115 to provide a gravitational force, $F_2$ 115*a*. The umbrella system 100 can also have a compound pulley component 120 including, for example, a class-1 pulley 120*a* attached to the static component 105, a class-2 pulley 120*b* attached to the dynamic component 110, and a pulley rope 120*c* (i) having a fixed end 120*d* and a weighted end 120*e* attached to the counterweight component 115, and (ii) in operable connection with the pulleys 120*a*, 120*b* to provide a mechanical advantage to the umbrella system 100.

In FIG. 1B, the umbrella system 100 comprises a static component 105, a dynamic component 110, a counterweight component 115, and a compound pulley component 120. The static component 105 can have a top portion 106, and the dynamic component 110 can include a retractable umbrella covering 110*a* having a center 110*b* and an outer edge 110*c*. The center 110*b* of the covering 110*a* can be attached to the top portion 106 of the cylindrical pole 105, and there can be a plurality of ribs 110*d* for supporting the umbrella covering 110*a*. There can also be a runner 110*e* circumscribing the pole 105, adapted to slide vertically on the pole 105 and coupled to the plurality of ribs 110*d* through a plurality of stretchers 110*f*. And, there can be a user rope 110*g* having a fixed-end 110*h* and a user-end 110*i*, the user end receiving a force, $F_1$ 110*j*, applied by a user to close the umbrella covering 110*a*. The umbrella system 100 can also have a counterweight component 115 to provide a gravitational force, $F_2$ 115*a*. The umbrella system 100 can also have a compound pulley component 120 including, for example, a class-1 pulley 120 attached to the static component 105, and a pulley rope 120*c* (i) having a fixed end 120*d* and a weighted end 120*e* attached to the counterweight component 115, and (ii) in operable connection with the pulleys 120*a*,120*b* to provide a mechanical advantage to the umbrella system 100.

Figure 2:
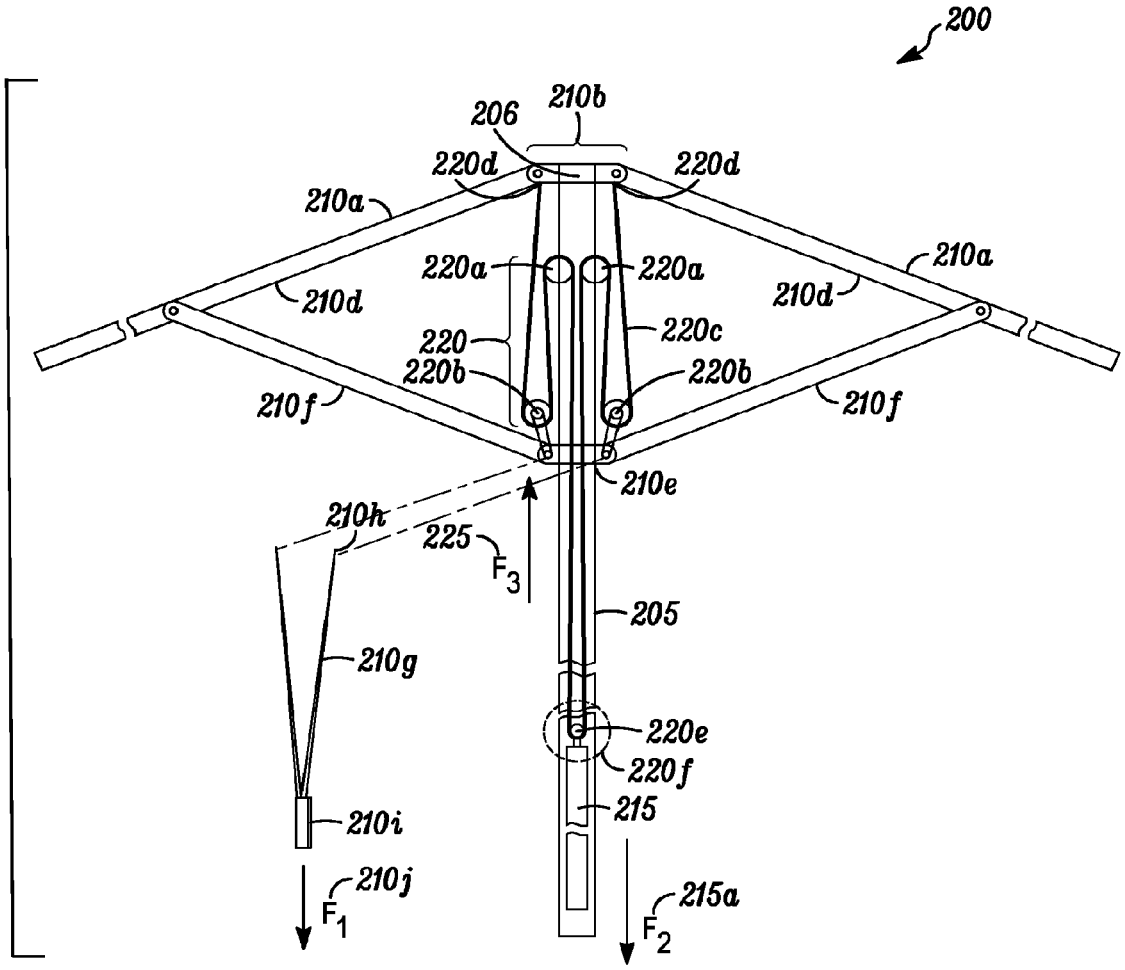
FIG. 2 illustrates a gravity-powered, self-opening patio umbrella, according to some embodiments.

FIG. 2 illustrates a gravity-powered, self-opening patio umbrella, according to some embodiments. The umbrella 200 can have a pole 205 with a top end portion 206; an umbrella covering 210*a* having a center 210*b* attached to the top end of the pole 206; a plurality of ribs 210*d* for supporting the umbrella covering 210*a*; a runner 210*e* that circumscribes the pole 205, is adapted to slide vertically on the pole 205 and is coupled to the plurality of ribs 210*d* through a plurality of stretchers 210*f*; a user rope 210*g* having a fixed end 210*h* and a user-end 210*i* that can receive a force $F_1$ 210*j* to close the umbrella covering 210*a* by a user; a counterweight 215 to provide a gravitational force, $F_2$ 215*a*, for a self-opening of the umbrella covering 210*a*; and, a pulley system 220 having a fixed pulley 220*a*, a moveable pulley 220*b*, and a pulley rope 220*c*. The pulley rope 220*c* can have a fixed end 220*d* for receiving $F_1$ 210*j* and a weighted end 220*e* attached to the counterweight 215. The pulley rope 220*c* can also be in operable connection with the pulleys 220 and the counterweight 215 to provide a mechanical advantage to the umbrella 200 of at least 2.

The teachings are also directed to a balanced, gravity-powered, and self-opening patio umbrella comprising a cylindrical pole, a retractable patio umbrella covering, a plurality of ribs for supporting the umbrella covering, a runner circumscribing the pole, a user rope, a counterweight, a pulley system. The cylindrical pole can have a base portion and a top portion. The retractable patio umbrella covering can have a center and an outer edge, the center attached to the top portion of the pole. The plurality of ribs can be used to support the umbrella covering and can emanate radially from the center to the outer edge of the umbrella covering. The runner can circumscribe the pole, be adapted to slide vertically on the pole, and be coupled to the plurality of ribs through a plurality of stretchers. The user rope can have a fixed end and a user end, the user end configured to receive a force $F_1$ from a user; and, the fixed end operably attached to the runner. The counterweight can provide a gravitational force, $F_2$, the counterweight contained within the cylindrical pole. And, the pulley system can have a fixed pulley, a moveable pulley, and a pulley rope. In some embodiments, the pulley rope can have (i) a fixed end for receiving the force $F_1$, (ii) a weighted end attached to the counterweight component, and (iii) an operable connection with the pulleys to provide a mechanical advantage to the umbrella of at least 2.

The teachings are also directed to a counterweighted, self-opening umbrella. The umbrella can have a pole with a top end and a bottom end, along with a retractable umbrella covering attached at its center to the top end of the pole. The umbrella can include a mechanical support framework for opening and retracting the umbrella covering. The umbrella can also include a fixed pulley operably attached to the pole, a moveable pulley operably attached to the mechanical support framework for the umbrella, a pulley rope in operable contact with the pulleys and a counterweight to open and retract the umbrella with a mechanical advantage of at least 2 from the pulleys, and a user rope having a fixed end and a user end, the user end receiving a force from a user to retract the retractable umbrella. The umbrella can (i) self-open using only the gravitational force of the counterweight and (ii) retract with a minimal force, due to the mechanical advantage.

The pole can comprise a cylindrical pole and, moreover, the cylindrical pole can contain the counterweight in some embodiments. In some embodiments, the pole can be hinged to allow for tilting. However, in some embodiments, the pole is rigid. In some embodiments, the user rope can be any type of rope known to one of skill. And, in some embodiments, the pulley rope can be any type of rope known to one of skill. For example, the rope can be a large stout cord of strands of fibers or wire twisted or braided together, or it can be a long slender strip of material used as rope. Any structure that can serve the purpose of a rope as intended can be used. Likewise, the pulleys can include any pulley structure known to one of skill. In fact, in some embodiments, the pulleys can be static or dynamic.

In some embodiments, $F_2$ is substantially greater than $f_t$+0.5 $F_3$; $F_3$ is the upward vertical force on the runner, in the absence of any friction, applied to open the umbrella covering; and, $f_t$ is the total frictional force in the system realized at the counterweight component. And, in some embodiments, $F_2$ can be at least 4 pounds greater than $f_t$+0.5 $F_3$, and $F_1$ can sometimes be no more than about 8 pounds. In some embodiments, the umbrellas taught herein can be designed such that the forces are balanced on each side of the pole. In some embodiments, the counterweight can range from about 2 pounds to about 20 pounds, from about 4 pounds to about 40 pounds, from about 3 pounds to about 30 pounds, from about 5 pounds to about 15 pounds, or any range therein. In some embodiments, the counterweight can be 4 pounds, 5 pounds, 6 pounds, 7 pounds, 8 pounds, 9 pounds, 10 pounds, 11 pounds, 12 pounds, 13 pounds, 14 pounds, or 15 pounds. One of skill will be able to adjust the counterweights as needed for any desired application.

It should be appreciated that ease-of-use can be measured by the force by which a user needs to pull the user rope to collapse (or retract) the umbrella covering (or canopy). In some embodiments, the user needs to apply a force ranging from about 1 pound to about 20 pounds, from about 2 pounds to about 15 pounds, from about 3 pounds to about 12 pounds, from about 4 pounds to about 10 pounds, from about 5 pounds to about 9 pounds, from about 6 pounds to about 8 pounds to collapse the canopy, or any range therein, to retract the canopy. And, in some embodiments, about 5-7 pounds of force is sufficient to retract the canopy.

In some embodiments, the umbrella coverings can range in diameter from about 4 feet to about 16 feet, from about 5 feet to about 15 feet, from about 6 feet to about 14 feet, from about 7 feet to about 13 feet, from about 8 feet to about 12 feet, from about 9 feet to about 11 feet, from about 6 feet to about 11 feet, from about 5 feet to about 12 feet, from about 8 feet to about 10 feet, or any range therein. In some embodiments, the diameter of the umbrella covering can be 5, 6, 7, 8, 9, 10, 11, 12, 13, 14, 15, 16, or any fraction thereof.

In some embodiments, the static component can range in height from about 4 feet to about 10 feet, from about 5 feet to about 10 feet, from about 6 feet to about 9 feet, from about 7 feet to about 8 feet, from about 8 feet to about 10 feet, from about 9 feet to about 10 feet, from about 6 feet to about 10 feet, from about 5 feet to about 8 feet, from about 7 feet to about 10 feet, or any range therein. In some embodiments, the height of the static component can be at or about 5, 6, 7, 8, 9, 10 feet, or any fraction thereof, such as inch increments in this range, and the like.

The counterweight is balanced against the weight of the umbrella covering, or canopy, as well as the mechanical construction used to raise the canopy. In some embodiments, the speed at which the canopy raises ranges from about 0.1 feet/second to about 4 feet/second, from about 0.2 feet/second to about 2 feet/second, from about 0.3 feet/second to about 1 foot/second. In some embodiments, the canopy can raise at a speed of about 0.5 feet/second.

In some embodiments, the compound pulley component can comprise two class-1 pulleys, two class-2 pulleys, and a cable-tension compensator pulley to balance forces between the pulleys. In some embodiments, the compound pulley component can comprise two fixed pulleys, two moveable pulleys, and a tension compensator pulley (see FIGS. 1A and 1B, 120*f*; and FIG. 2, 220*f*) to balance forces between the pulleys. The moveable pulleys, for example, can be (i) in operable contact with the rope, (ii) positioned between the fixed-end and the user-end of the rope, and (iii) function to provide the mechanical advantage. The system of pulleys can have one fixed pulley and one moveable pulley on each side of the pole, functioning to provide the mechanical advantage. Moreover, the pulley rope can comprise a cable rope.

In some embodiments, the umbrella comprises a counterweight system that can use any mechanism known to one of skill to provide the counterweight function or means. For example, the counterweight system can be fixed when open or allowed to remain dynamic or partially dynamic for the reasons discussed herein. In some embodiments, the system can include one or more pulleys and a gravitational force provided from any position within the system. In some embodiments, the system can have a counterweight exterior to the either the static or dynamic components of the system, or exterior to both. In some embodiments, the counterweight can be designed exterior to the pole or circumscribing the pole. And, in some embodiments, there can be a plurality of gravitational forces, where the opening of the canopy includes a mechanical advantage from a first gravitation force, and the closing of the canopy includes a mechanical advantage from a second gravitational force. In some embodiments, a spring-tension force can be used or combined with a gravitational force to provide a system of forces within an umbrella apparatus. Moreover, in some embodiments, a pneumatic or hydraulic force can be used or combined with a gravitational force or a spring-tension force to provide a system of forces within an umbrella apparatus.

The systems taught herein, regardless of how the design provides a source of forces used to open and/or close an umbrella canopy, can operate with or without a mechanical advantage. The design of the systems can include class 1 pulley systems, class 2 pulley systems or a combination thereof. In some embodiments, any system of pulleys or points of inflexion can be used such as, for example, class 1 pulleys, class 2 pulleys, fixed pivot points, or any combination thereof, to provide a mechanical advantage of greater than 1 where, in some embodiments, the mechanical advantage is 2.0 or greater.

The systems taught herein, regardless of how the design provides a source of forces used to open and close an umbrella canopy, can operate with or without an automatic opening of the canopy. In some embodiments, the counterweight may only assist in the opening of the umbrella. And, in some embodiments, a user can control the speed of opening by applying a counter force, for example, to the user rope. It should be appreciated, however, that the automatic opening option of the canopy provides users with a great advantage. In systems that provide automatic canopy opening, the user can easily open the canopy without discomfort which may be due to, for example, physical ailments or limited physical ability.

The systems taught herein, regardless of how the design provides a source of forces to open and close an umbrella canopy, can operate with a fixed and/or dynamic option for the canopy and/or runner. A "fixed" option can include, for example, a canopy that is at least substantially fixed in place after opening. A "dynamic" option can include, for example, a canopy that remains at least substantially moveable after opening. In these embodiments, the runner, for example, may be able to slide on the pole in response to a force applied to the canopy. Such force can be applied, for example, where (i) strong winds are present or (ii) any physical object strikes the canopy, for example, where a user inadvertently walks into the canopy. As such, one of skill will appreciate that the "dynamic" function includes a safety feature, as a heavy umbrella can do damage to persons or property if subject to forces sufficient to throw the umbrella from its position, for example. Also, a canopy that can retract when a user inadvertently walks into it will likely help prevent harm to the user. In addition, a canopy that can retract or otherwise respond dynamically to external forces may have a longer life. It should be appreciated that the systems taught herein may likewise be fully or partially fixed in position, such that the movement is at least substantially prevented, merely inhibited, or limited to a range. Likewise, the systems taught herein can be fully or partially dynamic, such that the movement could be allowed from a fully retracted position to a fully hyper-extended position of the canopy, or any range in-between. In some embodiments, "hyperextension" occurs when the canopy is allowed to raise above, and extend beyond, a normal operating position. In some embodiments, a stopper can be used to prevent the canopy from raising beyond the normal operating position and, in some embodiments, the stopper can be allowed to move dynamically through a range of movement, and this movement can be dampened through a dampening mechanism, to further control the range and speed of movement of the dynamic canopy. And, likewise, in some embodiments, the canopy is fixed in position after opening, such that the canopy is allowed no substantial movement from its position of operation. Moreover, a system can have any one or any combination of such options.

One of skill will appreciate that the umbrella components can be fabricated from any suitable material, such as plastic, textile, woven or non-woven material, natural products, metal, ceramics, any suitable polymer or polymers, resin composition, or a combination thereof, where a combination can include, for example, a coated material or, perhaps a reinforced material such as, for example, a fiber-reinforced structure. Umbrella components can be molded, cast or extruded, for example, as one or more pieces, assembled from a plurality of pieces, or a combination thereof. And, it should be appreciated that the umbrella system can be manufactured in any size suitable for a particular purpose, where the number and type of components needed or desired for a particular purpose can be readily determined by one of skill.

Example 1

A prototype based on the design of FIG. 1A was built to prove the concept. The system operates dynamically through gravitational power supplied from the system of the counterweight and pulleys. The system opens automatically upon releasing the user rope and facilitating the downward movement of the counterweight. And, the system can optionally lock in place in the open position; or, it can remain flexible, such that the canopy can move in response to external forces. For example, the canopy can retract in response to external wind forces that may be present during operation of the umbrella, if the system is allowed to move/flex in the direction of retraction.

The umbrella system tested had a counterweight of about 8 pounds and the pulley system used 4 pulleys and a tension compensator pulley. On each side of the umbrella, the system had a class-1 pulley attached to the static component, and a class-2 pulley attached to the dynamic component. The tension compensator pulley was located at the weighted end of the pulley rope just above the counterweight component, as shown in the figures provided herein, and it was used to balance the tension between the class 1/class 2 pulley combination on the left side of the pole with the class 1/class 1 pulley combination on the right side of the pole.

Using this system, for example, the speed at which the umbrella opens in the absence of wind was approximately 2 feet of counterweight movement in 4 seconds to raise the approximately 9 foot canopy. A user was able to retract the canopy of this system by applying only about 6 pounds of force to the user rope.

Example 2

The flexibility of the system of Example 1 to winds was tested. It was surprising and unexpected to see the system withstand some relatively strong winds during testing. Current, state-of-the-art umbrella systems are not dynamic and do not open and retract in response to winds, even strong winds and, as a result, tend to capture the wind and cause operational difficulties. These difficulties can potentially cause damage to persons and/or property. A system that can retract in response to wind, for example, can flex with such external forces. The retraction of the canopy can prevent or inhibit the capturing of wind, where capturing wind can result in high forces that lift and throw even some of the heaviest umbrellas available into persons and/or property. The umbrella of this example was found to merely retract in response to wind, retracting more as the wind forces increased and re-opening as the forces decreased.

Figure 3:
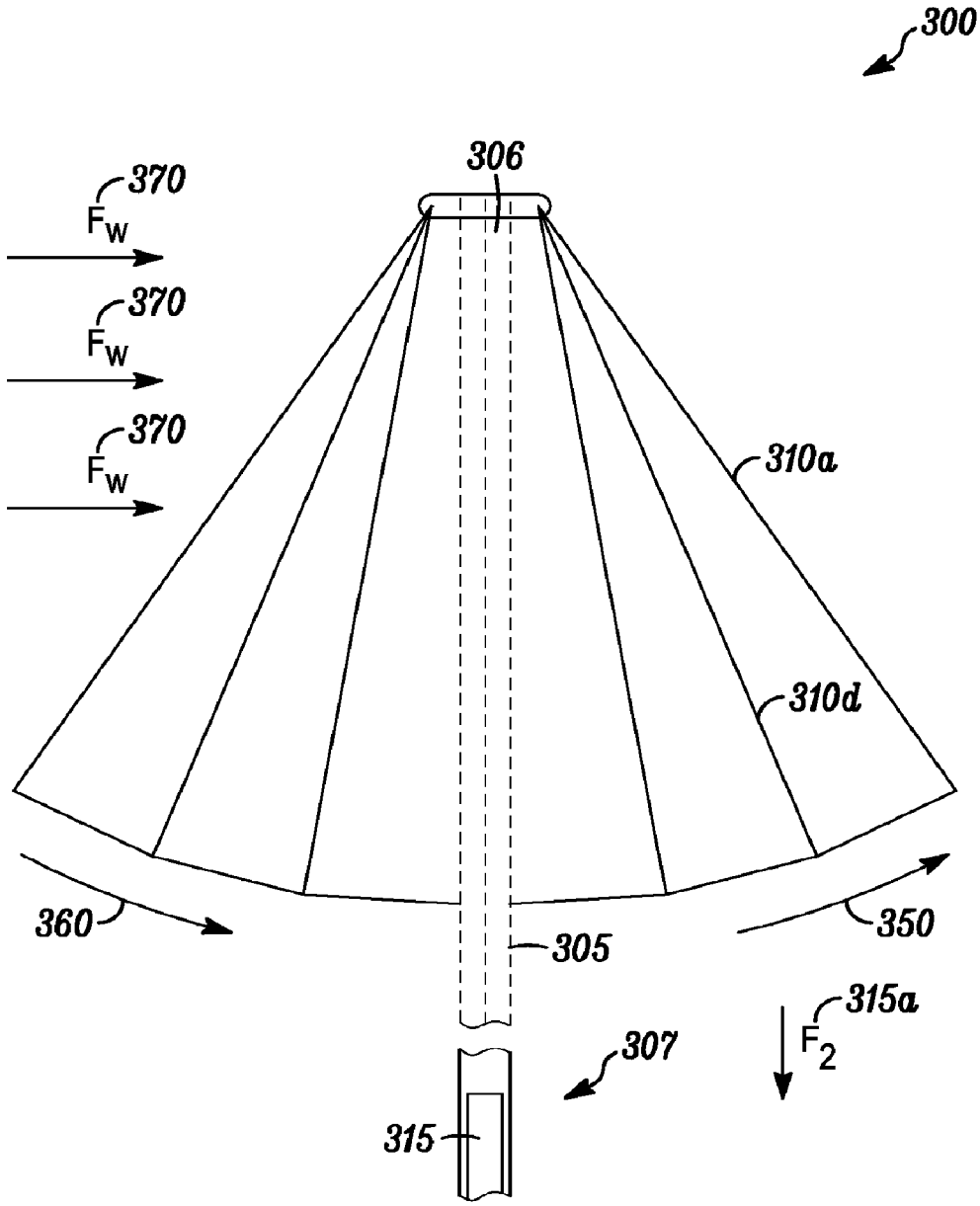
FIG. 3 illustrates an umbrella's flexible reaction to the wind, according to some embodiments.

FIG. 3 illustrates an umbrella's flexible reaction to the wind, according to some embodiments. The patio umbrella 300 has a pole 305 with a top 306 and a bottom portion 307, a retractable umbrella covering 310*a* with supporting ribs 310*d* attached to the top portion 306 of the pole 305, and a counterweight 315.

The umbrella covering 310*a* self-opens using only the gravitational force, $F_2$, 315*a* of the counterweight 315. The umbrella covering 310*a* opens in the opening direction 350 together with the downward movement of the counterweight 315 in the direction of $F_2$ 315*a*. The umbrella 300 comes down in the retraction direction 360 under the force of the wind, $F_w$, 370 and the umbrella covering 310*a* retracts up to about a 45 degree angle in the retraction direction 360 with the upward movement of the counterweight 315 against the direction of $F_2$ 315*a*.

The umbrella self-opens as soon as the wind stops or slows down. And, it should be appreciated that force, $F_2$ 315*a* of the counterweight 315 can be readily adjusted to any wind condition of the environment in which the umbrella system is used. Surprisingly, the system could easily withstand winds of at least 25-30 miles/hour with its dynamic and flexible reaction to the wind. And, the system appeared to be ready to take more wind forces.

One of skill reading the teachings will appreciate that the concepts can extend into additional embodiments that go well-beyond a literal reading of the claims, the inventions recited by the claims, and the terms recited in the claims. It will be appreciated that the terms "operable," "configured," and like terms, can be used in connection with a function of the systems, components, or parts of the systems taught herein, such that the systems, components, or parts can be operable to function in a specified manner or configured to operate or function in a specified manner. Likewise, the phrase "operably attached to," "operably configured with," "in operable contact with," and like terms, can be used with to describe interrelationships between and within the teachings provided herein.

I claim:

1. A gravity-powered, and self-opening umbrella system, comprising:

a static component including a pole having a top portion;

a dynamic component including a retractable umbrella covering having a center and an outer edge, the center attached to the top portion of the pole;

a plurality of ribs for supporting the umbrella covering;

a runner circumscribing the pole, adapted to slide vertically on the pole and coupled to the plurality of ribs through a plurality of stretchers; and, a user rope having a fixed-end and a user-end, the user end receiving a force, $F_1$, applied by a user to close the umbrella covering, the fixed end of the user rope operably attached to the runner;

a counterweight component to provide a gravitational force, $F_2$, and, a compound pulley component including at least one class-1 pulley attached to the static component;

at least one class-2 pulley attached to the dynamic component; and, a pulley rope (i) having a fixed end and a weighted end attached to the counterweight component, and (ii) in operable connection with the pulleys to provide a mechanical advantage to the umbrella system, the fixed end of the pulley rope operably attached to the static component above the class-2 pulley;

wherein, $F_2$ is substantially greater than $f_t$+0.5 $F_3$ for a self-opening of the umbrella covering;

$F_3$ is an upward vertical force on the runner, in the absence of any friction, applied to open the umbrella covering; and, $f_t$ is the total frictional force in the system realized at the counterweight component.

2. The system of claim 1, wherein the umbrella covering is a patio umbrella covering.

3. The system of claim 1, wherein the pole comprises a cylindrical pole.

4. The system of claim 1, wherein the pulley rope comprises a cable rope.

5. The system of claim 1, wherein the forces $F_1$ and $F_3$ are balanced on each side of the pole, and the compound pulley component comprises two class 1 pulleys, two class 2 pulleys, and a cable-tension compensator pulley to balance forces between the pulleys.

6. The system of claim 1, wherein the cylindrical pole contains the counterweight.

7. The system of claim 1, wherein $F_2$ is at least 4 pounds greater than $f_t$+0.5 $F_3$, and $F_1$ is no more than about 8 pounds.

8. A gravity-powered, self-opening umbrella, comprising:

a pole having a top end portion;

a retractable umbrella covering having a center, the center attached to the top end portion of the pole;

a plurality of ribs for supporting the umbrella covering;

a runner circumscribing the pole, adapted to slide vertically on the pole and coupled to the plurality of ribs through a plurality of stretchers;

a user rope having a fixed-end and a user-end, the user end receiving a force, $F_1$, applied by a user to close the umbrella covering, and the fixed end of the user rope operably attached to the runner;

a pulley system having at least one fixed pulley, at least one moveable pulley, and a pulley rope, the pulley rope (i) having a fixed end for receiving the force $F_1$ and a weighted end attached to a counterweight component, and (ii) in operable connection with the pulleys and the counterweight component to provide a mechanical advantage to the umbrella of at least 2, the fixed end of the pulley rope operably attached to the top end portion of the pole;

and, a counterweight to provide a gravitational force, $F_2$, for a self-opening of the umbrella covering.

9. The umbrella of claim 8, wherein the umbrella covering is a patio umbrella covering.

10. The umbrella of claim 8, wherein the pole comprises a cylindrical pole.

11. The umbrella of claim 8, wherein the rope comprises a cable rope.

12. The umbrella of claim 8, wherein the forces are balanced on each side of the pole, and the pulley system comprises two fixed pulleys, two moveable pulleys, and a tension compensator pulley to balance forces between the pulleys.

13. The umbrella of claim 8, wherein the cylindrical pole contains the counterweight.

14. The umbrella of claim 8, wherein, $F_2$ is substantially greater than $f_t$+0.5 $F_3$;

$F_3$ is the upward vertical force on the runner, in the absence of any friction, applied to open the umbrella covering; and, $f_t$ is the total frictional force in the system realized at the counterweight component.

15. The umbrella of claim 8, wherein $F_2$ is at least 4 pounds greater than $f_t$+0.5 $F_3$, and $F_1$ is no more than about 8 pounds.

16. A balanced, gravity-powered, and self-opening patio umbrella, comprising:

a cylindrical pole having a base portion and a top portion;

a retractable patio umbrella covering having a center and an outer edge, the center attached to the top portion of the pole;

a plurality of ribs for supporting the umbrella covering and emanating radially from the center to the outer edge of the umbrella covering;

a runner circumscribing the pole, adapted to slide vertically on the pole and coupled to the plurality of ribs through a plurality of stretchers;

a user rope having a fixed end and a user end, the user end configured to receive a force $F_1$ from a user; and, the fixed end of the user rope operably attached to the runner;

a counterweight to provide a gravitational force, $F_2$, the counterweight contained within the cylindrical pole; and, a pulley system having at least one fixed pulley, at least one moveable pulley, and a pulley rope, the pulley rope having (i) a fixed end for receiving the force $F_t$, (ii) a weighted end attached to the counterweight component, and (iii) an operable connection with the pulleys to provide a mechanical advantage to the umbrella of at least 2 the fixed end of the pulley rope operably attached to the top portion of the cylindrical pole;

wherein, $F_2$ is substantially greater than $f_t$+0.5 $F_3$ for a self-opening of the umbrella covering;

$F_3$ is the upward vertical force on the runner, in the absence of any friction, applied to open the umbrella covering; and, $f_t$ is the total frictional force in the system realized at the counterweight component.

17. The umbrella of claim 16, wherein $F_2$ is at least 4 pounds greater than $f_t$+0.5 $F_3$, and $F_1$ is no more than about 8 pounds.

18. The umbrella of claim 16, wherein the forces are balanced on each side of the pole, the system of pulleys having two fixed pulleys and two moveable pulleys (i) in operable contact with the rope, (ii) positioned between the fixed-end and the user-end of the rope, and (iii) functioning to provide the mechanical advantage.

19. The umbrella of claim 16, wherein the system of pulleys has two fixed pulleys, two moveable pulleys, and a tension-compensator pulley to balance the forces between the pulleys; the system of pulleys (i) in operable contact with the rope, (ii) positioned between the fixed-end and the user-end of the rope, (iii) having one fixed pulley and one moveable pulley on each side of the pole, and (iv) functioning to provide the mechanical advantage.

20. A counterweighted, self-opening umbrella having a pole with a top end and a bottom end, a retractable umbrella covering attached at its center to the top end of the pole, a mechanical support framework for opening and retracting the umbrella covering, a fixed pulley operably attached to the pole, a moveable pulley operably attached to the mechanical support framework for the umbrella, a pulley rope in operable contact with the pulleys and a counterweight to open and retract the umbrella with a mechanical advantage of at least 2 from the pulleys, and a user rope having a fixed end and a user end, the user end receiving a force from a user to retract the retractable umbrella, and the fixed end operably attached to the runner; wherein, the umbrella (i) self-opens using only the gravitational force of the counterweight and (ii) retracts with a minimal force, due to the mechanical advantage.

* * * * *